US005644835A

United States Patent [19]

Villringer

[11] Patent Number: 5,644,835

[45] Date of Patent: Jul. 8, 1997

[54] HEATING ELEMENT METHOD

[75] Inventor: Egan Villringer, Brampton, Canada

[73] Assignee: Mold-Masters Limited, Georgetown, Canada

[21] Appl. No.: 708,814

[22] Filed: Sep. 9, 1996

[30] Foreign Application Priority Data

Aug. 20, 1996 [CA] Canada ..... 2183722

[51] Int. Cl.[6] ..... H05B 3/00; H01C 17/28

[52] U.S. Cl. ..... 29/611; 29/593; 29/615; 29/619; 29/DIG. 46

[58] Field of Search ..... 29/593, 610.1, 29/611, 615, 619, 621; 219/542; 338/238, 296, 331

[56] References Cited

U.S. PATENT DOCUMENTS 1,367,341 2/1921 Abbott .
5,282,735 2/1994 Gellert .

FOREIGN PATENT DOCUMENTS 269227 4/1927 United Kingdom ..... 338/331

*Primary Examiner*—P. W. Echols
*Attorney, Agent, or Firm*—Dalesman & Company

[57] ABSTRACT

A method of making an elongated electrical heating element having a resistance wire with a helical portion extending between two lead pins surrounded by compacted insulating powder in an outer casing. The lead pins are attached to a tightly coiled resistance wire by screwing threaded portions at the inner ends of the lead pins into coiled portions at the outer ends of the resistance wire. The lead pins are pulled further apart to stretch the coiled resistance wire to form the helical portion of the resistance wire and then attached to a resistance meter. One of the lead pins is then rotated relative to the other lead pin to adjust the effective electrical resistance of the heating element to an accurate and uniform valve. The resistance wire and lead pins are mounted in an outer casing which further stretches the helical portion to a predetermined length. The outer casing is then filled with insulating powder in a conventional vibrating filling machine. Finally, the casing is compressed to compact the insulating powder around the heating element.

3 Claims, 3 Drawing Sheets

HEATING ELEMENT METHOD

BACKGROUND OF THE INVENTION

This invention relates to elongated electrical heating elements and more particularly to a method of making such heating elements having uniform accurate resistance values.

Elongated electrical heating elements are commonly used in the injection molding field by integrally incorporating them in heated nozzles. One example is shown in the applicant's U.S. Pat. No. 5,282,735 which issued Feb. 1, 1994. It is well known to make elongated electrical heating elements by compacting a helical resistance wire in a powdered insulative material in an outer casing. As shown in U.S. Pat. No. 1,367,341 to Abbott which issued Feb. 1, 1921, it is also known to connect the inner ends of lead wires to opposite ends of a coiled resistance wire. Some high quality multi-cavity applications require the temperatures of all the different nozzles in the system to be the same. However, heating elements made by current methods have resistance deviations of up to plus or minus five to ten percent. This is not accurate enough to provide sufficiently uniform temperatures between the nozzles for many applications, with the result that separate temperature control stations must be provided for each nozzle in the system. This has the disadvantages to being more costly and subject to malfunctions.

SUMMARY OF THE INVENTION

Accordingly, it is an object of the present invention to at least partially overcome the disadvantages of the prior art by providing a method of making elongated electrical heating elements having accurate uniform electrical resistance.

To this end, in one of its aspects, the invention provides a method of making an elongated electrical heating element having a resistance wire extending between two lead pins each surrounded by an insulating powder in an outer casing. The resistance wire has a helical portion extending between coiled portions at either end. Each of the lead pins is threaded to provide a threaded portion adjacent its inner end. The threaded portion of one lead pin is screwed into the coiled portion at one end of the resistance wire to connect the resistance wire to that lead pin. The threaded portion of the other lead pin is screwed into the coiled portion at the other end of the resistance wire to connect the other end of the resistance wire to the other lead pin and the tightly coiled resistance wire is stretched between the two lead pins to form the helical portion. The outer ends of the lead pins are attached to a resistance indicator to indicate the effective electrical resistance of the helical portion of the resistance wire between the lead pins. One of the lead pins is rotated relative to the other of the lead pins to adjust the effective electrical resistance of the helical resistance wire between the lead pins to a predetermined value. The resistance wire with the two lead pins attached is mounted in an outer cylindrical casing which further stretches the helical portion to a predetermined length. The outer casing is then filled with a powdered insulative material to surround the resistance wire and threaded portions of the lead pins. The casing is then compressed to compact the powdered insulative material around the resistance wire.

Further objects and advantages of the invention will appear from the following description taken together with the accompanying drawings.

DETAILED DESCRIPTION OF THE INVENTION

Figure 1:
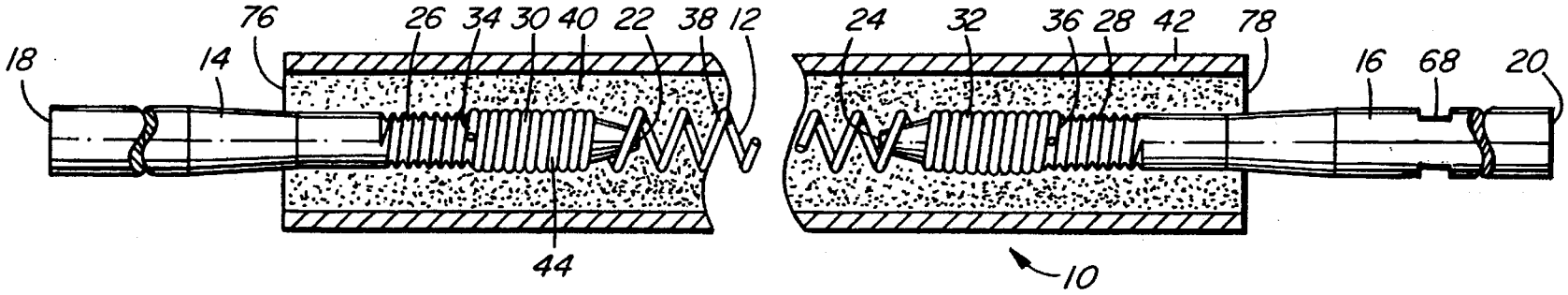
FIG. 1 is a sectional view of a portion of a completed electrical heating element made according to a preferred embodiment of the invention.

As seen in FIG. 1, the completed heating element 10 has a helical resistance wire 12 extending between first and second lead pins 14, 16. The lead pins 14, 16 have outer ends 18, 20, inner ends 22, 24, and threaded portions 26, 28 adjacent the inner ends 22, 24. The resistance wire has coiled portions 30, 32 extending from its ends 34, 36 and a helical portion 38 extending between the coiled portions 30, 32. The resistance wire 12 and the threaded portions 26, 28 of the lead pins 14, 16 are surrounded by compacted insulating powder 40 such as magnesium oxide in an elongated cylindrical outer casing 42 formed of a suitable material such as steel. The resistance wire 12 has a small diameter with enough resistance to generate sufficient heat from the current flowing through it.

Reference is now made to FIGS. 2 through 7 in describing the method of making the heating elements 10 according to a preferred embodiment of the invention. The resistance wire 12 is made of a chromium-nickel alloy and wound in a tight coil 44 having a predetermined diameter. The lead pins 14, 16 are made of steel with the threaded portions 26, 28 having a diameter which fits inside the coil 44 of the resistance wire 12. Of course, this relatively large diameter will result in very little heat being produced as the current flows through the lead pins 14, 16. This size of the threads themselves will match the size of the resistance wire 12 to be received in them. One of the lead pins 14 is made with a hook 46 at its outer end 18.

Figure 2:
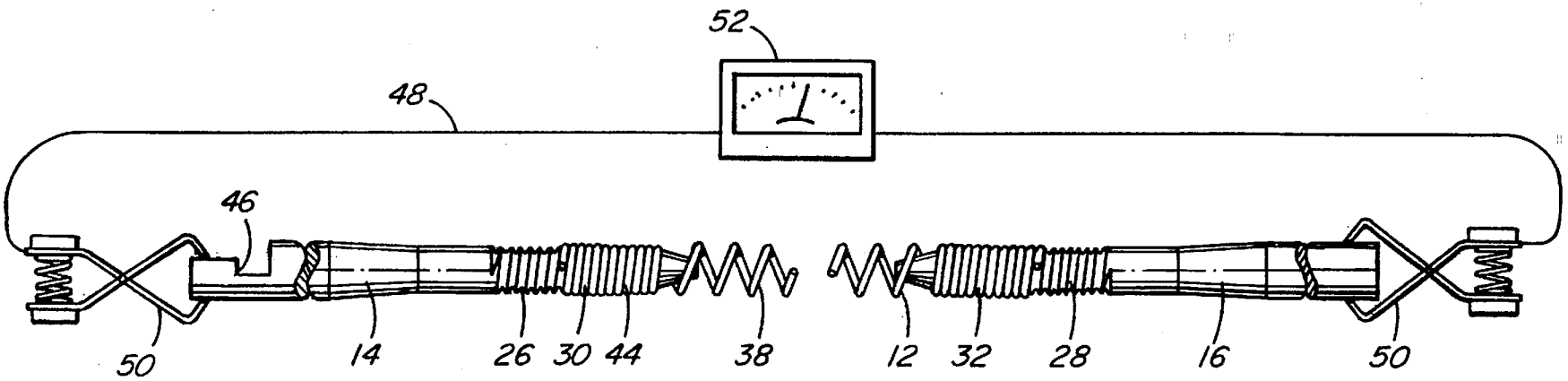
FIG. 2 shows how the helical resistance wire is mounted between the two lead wires, connected to an ohmmeter and then rotated for adjustment of the resistance.

As seen in FIG. 2, the threaded portion 26, 28 of the lead pins 14, 16 are first screwed into the coiled portions 30, 32 of the resistance wire 12 far enough to securely attach the lead pins 14, 16 to the resistance wire 12. As mentioned above, the size of the resistance wire 12 fits in the threads, and the threaded portions 26, 28 fit in the coiled portions 30, 32 of the resistance wire 12 with enough friction to hold them in place but yet allow them to be turned. Then the lead pins 14, 16 are pulled further apart to stretch the coiled resistance wire 12 to form the helical portion 38 and attached by lead wires 48 having alligator clips 50 to a resistance indicator or ohmmeter 52. One or both of the lead pins 14, 16 is then manually rotated relative to the other of the lead pins 14, 16 to lengthen or shorten the helical portion 38 of the resistance wire 12 to adjust the effective electrical resistance of the resistance wire 12 between the two lead pins 14, 16 and set it at a predetermined value. This ensures that the electrical resistance of all of the heating elements made with this same setting will be accurate and uniform. The resistance wire 12 can then be tack welded at its ends 34, 36 to the lead pins 14, 16 to ensure there is no further rotation between them, although this has not been found to be necessary.

Figure 3:
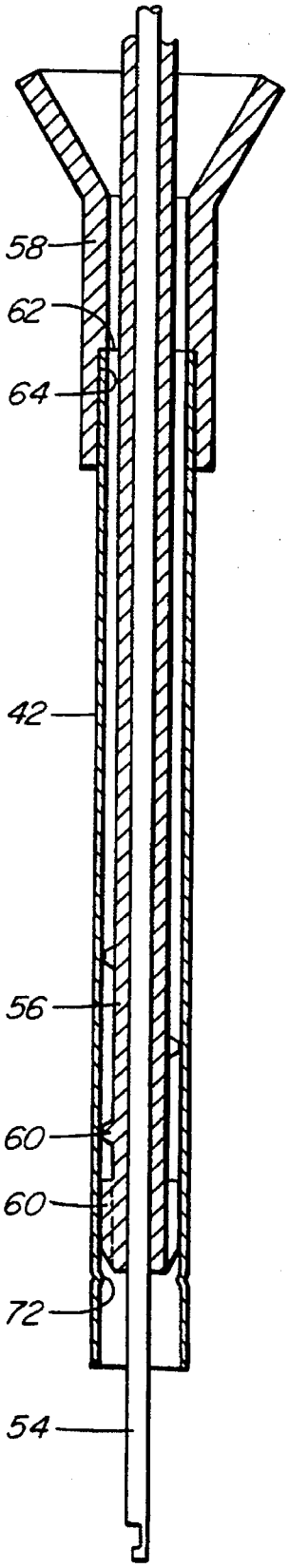
FIGS. 3–7 are partial sectional views showing the further sequence of steps involved in making the heating element.

Conventional vibrating filling machines made by Oakley Industries, Inc. have mountings for simultaneously filling a number of casings 42. As shown in FIG. 3, each mounting includes a hook rod 54 which slides in a retaining sleeve 56 extending from a funnel portion 58. As shown, the outer casing 42 is mounted in an upright position over locating fins 60 extending from the retaining sleeve 56 with the upper end 62 of the casing 42 received in a seat 64 in the funnel portion 58.

Figure 4:
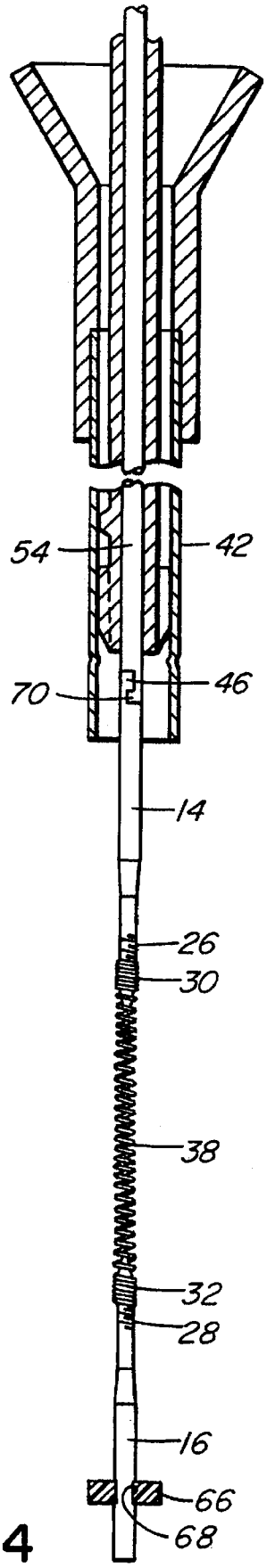
Figure 5:
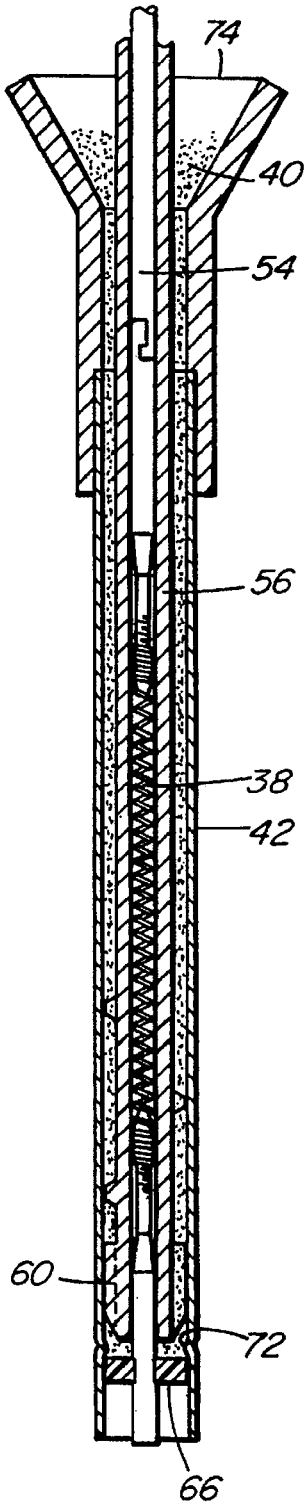
Figure 6:
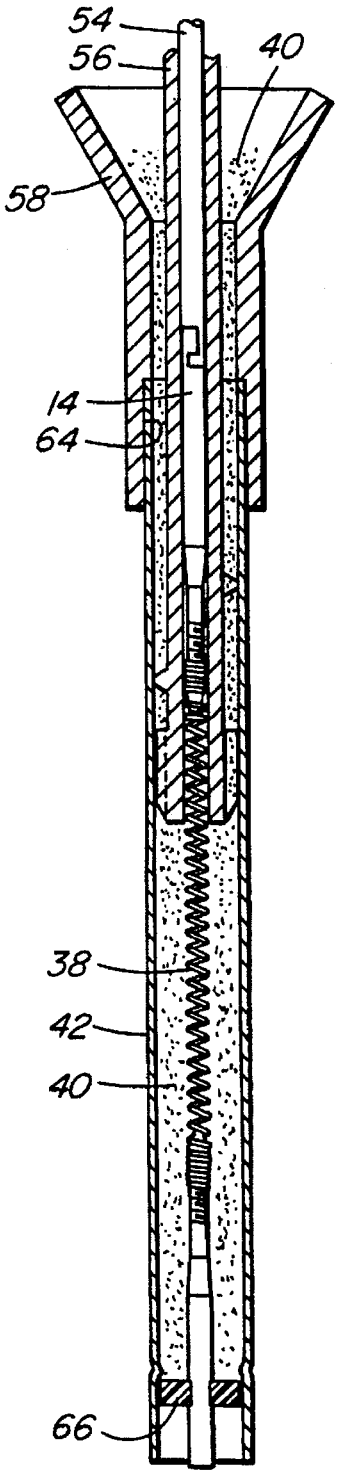
Figure 7:
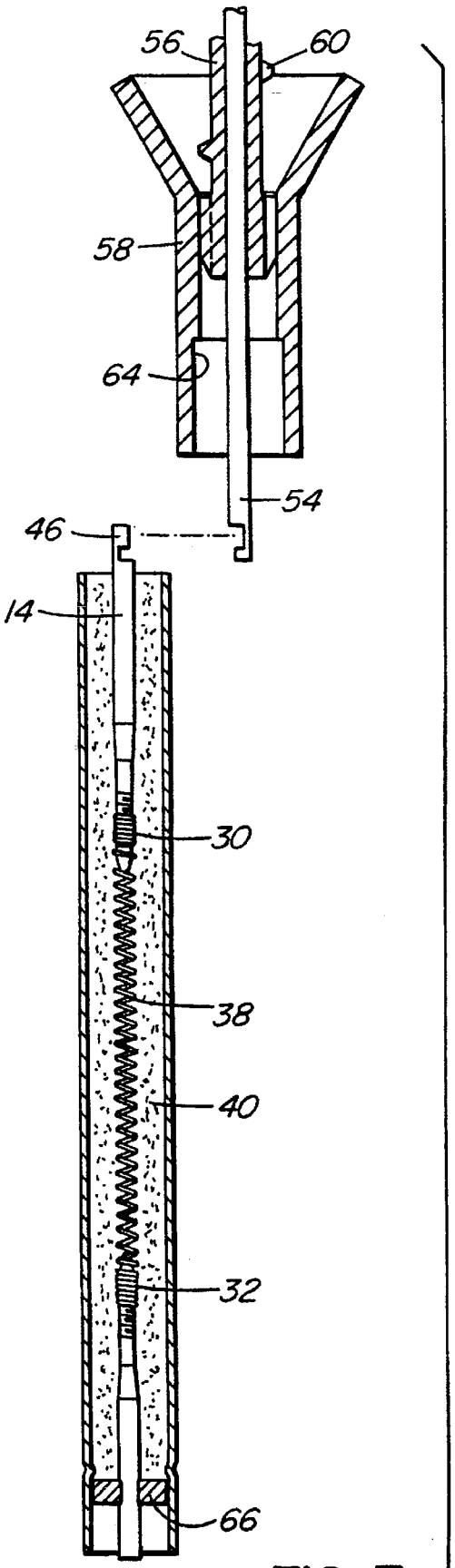

A fiber washer 66 is pressed onto lead pin 16 where it is received in a groove 68. Then, as seen in FIG. 4, the hook 46 at the outer end 18 of lead pin 14 is connected to a hook 70 at the lower end of the hook rod 54. The hook rod 54 is then retracted in the retaining sleeve 56 and locked in the position shown in FIG. 5 in which the fiber washer 66 abuts against a crimp or indent 72 in the outer casing 42 and the helical portion 38 of the resistance wire 12 is further stretched to a predetermined length. The retaining sleeve 56 holds the resistance wire 12 in this central position in the outer casing 42 while insulating powder 40 is poured into the mouth 74 of the funnel portion 58. The assembly is vibrated continually and the insulating powder 40 runs down past the locating fins 60 to fill the space around and below the retaining sleeve 56. This continues as the hook rod 54 is retracted to lift the retaining sleeve 56 and the insulating powder 40 pours in around the resistance wire 12 as seen in FIG. 6. When the retaining sleeve 56 is fully retracted and the outer casing 42 is completely filled with insulating powder 40, the outer casing 42 is withdrawn from the seat 64 and the lead pin 14 is disconnected from the hook rod 54 as shown in FIG. 7. Another fiber washer (not shown) is mounted in the upper end 62 of the casing 42 to retain the insulating powder 40 in place.

The outer casing 42 is then rolled or swaged to compact the insulating powder 40 around the resistance wire 12. Finally, portions of the outer casing 42 and the compacted insulating powder are cut off to leave the completed heating element 10 as seen in FIG. 1. The ends 76, 78 of the compacted insulating powder 40 can be coated with silicone oil to provide a moisture seal.

While the description of the method of making the heating element 10 has been given with respect to a preferred embodiment, it will be evident that various other modifications are possible without departing from the scope of the invention as understood by those skilled in the art and as defined in the following claims:

The embodiments of the invention in which an exclusive property or privilege is claimed is defined as follows:

1. In a method of making an elongated electrical heating element having a resistance wire extending between first and second lead pins and surrounded by an insulating powder in an outer casing, the resistance wire having a first coiled portion extending from a first end, a second coiled portion extending from a second end, and a helical portion extending between the first and second coiled portions, each of the lead pins having an outer end and an inner end, the method including connecting the first lead pin to the first end of the helical resistance wire connecting the second lead pin to the second end of the helical resistance wire, stretching the resistance wire between the first and second lead pins to form the helical portion of the resistance wire, mounting the helical resistance wire with the first and second lead pins attached thereto in an outer cylindrical casing, filling the outer casing with a powdered insulative material to surround the resistance wire and the threaded portions of the first and second lead pins, and compressing the casing to compact the powdered insulative material around the resistance wire, the improvement comprising the further steps of:

(a) threading each of the lead pins to provide each of the lead pins with a threaded portion adjacent the inner end of each lead pin, (b) screwing the threaded portion of the first lead pin into the first coiled portion adjacent the first end of the helical resistance wire to connect the resistance wire to the first lead pin, (c) screwing the threaded portion of the second lead pin into the second coiled portion adjacent the second end of the helical resistance wire to connect the resistance wire to the second lead pin, and after stretching the resistance wire between the first and second lead pins to form the helical portion of the resistance wire;

(d) connecting the outer ends of the first and second lead pins to a resistance indicator to indicate the effective electrical resistance of the helical portion of the resistance wire between the first and second lead pins, and (e) rotating one of the first and second lead pins relative to the other of the first and second lead pins to adjust the effective electrical resistance of the helical portion of the resistance wire between the first and second lead pins to a predetermined value.

2. A method as claimed in claim 1 wherein the resistance wire is made in a coil having a predetermined inner diameter, and wherein the threaded portion of each of the first and second lead pins are made with an outer diameter which fits in the said inner diameter of the coil.

3. A method as claimed in claim 2 wherein the size of the threads of the threaded portions of the lead pins substantially matches the size of the resistance wire to be received in the threads of the threaded portion.

* * * * *